US006666144B1

(12) United States Patent
Kim et al.

(10) Patent No.: US 6,666,144 B1
(45) Date of Patent: Dec. 23, 2003

(54) WARHEAD DECOUPLING BEARING

(75) Inventors: Steven S. Kim, Crofton, MD (US); Eric J. Hawley, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/292,949

(22) Filed: Nov. 13, 2002

(51) Int. Cl.[7] ..... F42B 15/36
(52) U.S. Cl. ..... 102/374; 102/293; 244/3.23
(58) Field of Search ..... 102/293, 372–378; 244/3.23

(56) References Cited

U.S. PATENT DOCUMENTS 2,849,955 A * 9/1958 Smathers ..... 244/3.23
3,067,681 A * 12/1962 Beman ..... 244/3.23
4,076,187 A * 2/1978 Metz ..... 244/3.23

FOREIGN PATENT DOCUMENTS

GB 1023404 * 3/1966 ..... 244/3.23

* cited by examiner

*Primary Examiner*—Harold J. Tudor
(74) *Attorney, Agent, or Firm*—Mark Homer

(57) ABSTRACT

The invention comprises an improved precision rocket motor and warhead system by increasing the spin rate of the rocket motor. The system comprises an outer housing segment attached to the end of a rocket motor tube and an annular sleeve placed within the end of the outer housing segment so that the end of the sleeve is aligned with the end of the segment. At least two annular bearings are placed around the outer surface of the sleeve. Normally the annular bearings will be made of a plastic type material that can be "stretched" around the outside of the sleeve prior to placing it within the outer housing segment. The inner surface of the sleeve will include a warhead attachment mechanism to secure the warhead to the inner surface. Finally, the invention includes a locking mechanism that locks the sleeve in place within the outer housing segment while attaching the warhead to the sleeve and unlocks to allow the sleeve to rotate independently of the rocket motor.

16 Claims, 1 Drawing Sheet

WARHEAD DECOUPLING BEARING

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field Of The Invention

The present invention pertains to mechanisms to decouple a warhead from a rocket motor to improve the precision of the rocket motor and more particularly to a bearing system to decouple a warhead from a rocket motor.

2. Description Of The Related Art

The precision of current rocket motors relates directly to the spin rate that they are capable of obtaining during use. When the spin rate is increased, this improves the precision of the rocket motor. In certain rocket motor systems, flutes are machined in the rocket nozzle body in order to generate torque, which, in turn, generates spin of the rocket motor during use. For example, flutes within a typical 2.75 inch rocket motor can generate a maximum of approximately 3 ft-lbs of torque. The spin rate that is generated from this torque relates directly to the weight of the warhead/rocket motor system.

One method that has been employed to reduce the weight of rocket motor portion of the system in order to increase the spin rate of the rocket motor, is to decouple the warhead from the rocket motor during use so the warhead spins separately from the rocket motor. Therefore, the same torque as discussed above can be applied to only the rocket motor, which weighs significantly less without the warhead attached, thus creating a higher spin rate. Many larger warhead/rocket motor systems use ball bearing systems to decouple the warhead from the rocket motor. However, in order to meet the precision requirements for military applications, such a ball bearing must be custom made. Also, because ball bearings require liquid lubrication in order to operate effectively, in order to maintain the systems over a long shelf life, regular service is required for such systems. Thus, for smaller warhead/rocket motor systems, it is not cost effective to employ such a decoupling system.

Therefore, it is desired to provide a low-cost system to decouple a warhead from a rocket motor during use for smaller warhead/rocket motor systems.

SUMMARY OF THE INVENTION

The present invention comprises annular bearings that allow a warhead to decouple from a rocket motor during use to increase the spin rate of the rocket motor, and, in turn, increase the precision of the rocket motor. The present invention is designed to be a low-cost, maintenance free alternative to ball bearing decouplers.

Accordingly, it is an object of this invention to provide a low-cost alternative to ball bearing decouplers for rocket motor and warhead systems.

It is a further object of this invention to provide a maintenance free bearing decoupler for rocket motor and warhead systems.

A still further object of this invention is to provide a more precise rocket motor and warhead system.

This invention accomplishes these objectives and other needs related to rocket motor and warhead systems by providing an improved precision rocket motor and warhead system by increasing the spin rate of the rocket motor. The system comprises a rocket motor tube with an outer housing segment attached to one end. An annular sleeve placed within the outer housing segment so that the end of the sleeve is aligned with the end of the outer housing segment. At least two annular bearings are placed around the outer surface of the sleeve. Normally the annular bearings will be made of a plastic type material that can be "stretched" around the outside of the sleeve prior to placing it within the outer housing segment. The inner surface of the sleeve will include a warhead attachment mechanism to secure the warhead to the inner surface. Finally, the invention includes a locking mechanism that locks the sleeve in place within the outer housing segment while attaching the warhead to the sleeve and unlocks to allow the sleeve to rotate independently of the rocket motor tube.

BRIEF DESCRIPTION OF THE DRAWINGS

The accompanying drawing, which is incorporated in and constitutes a part of the specification, illustrates an embodiment of the invention, and, together with the description, serves to explain the principles of the invention.

DESCRIPTION OF THE PREFERRED EMBODIMENT

Figure 1:
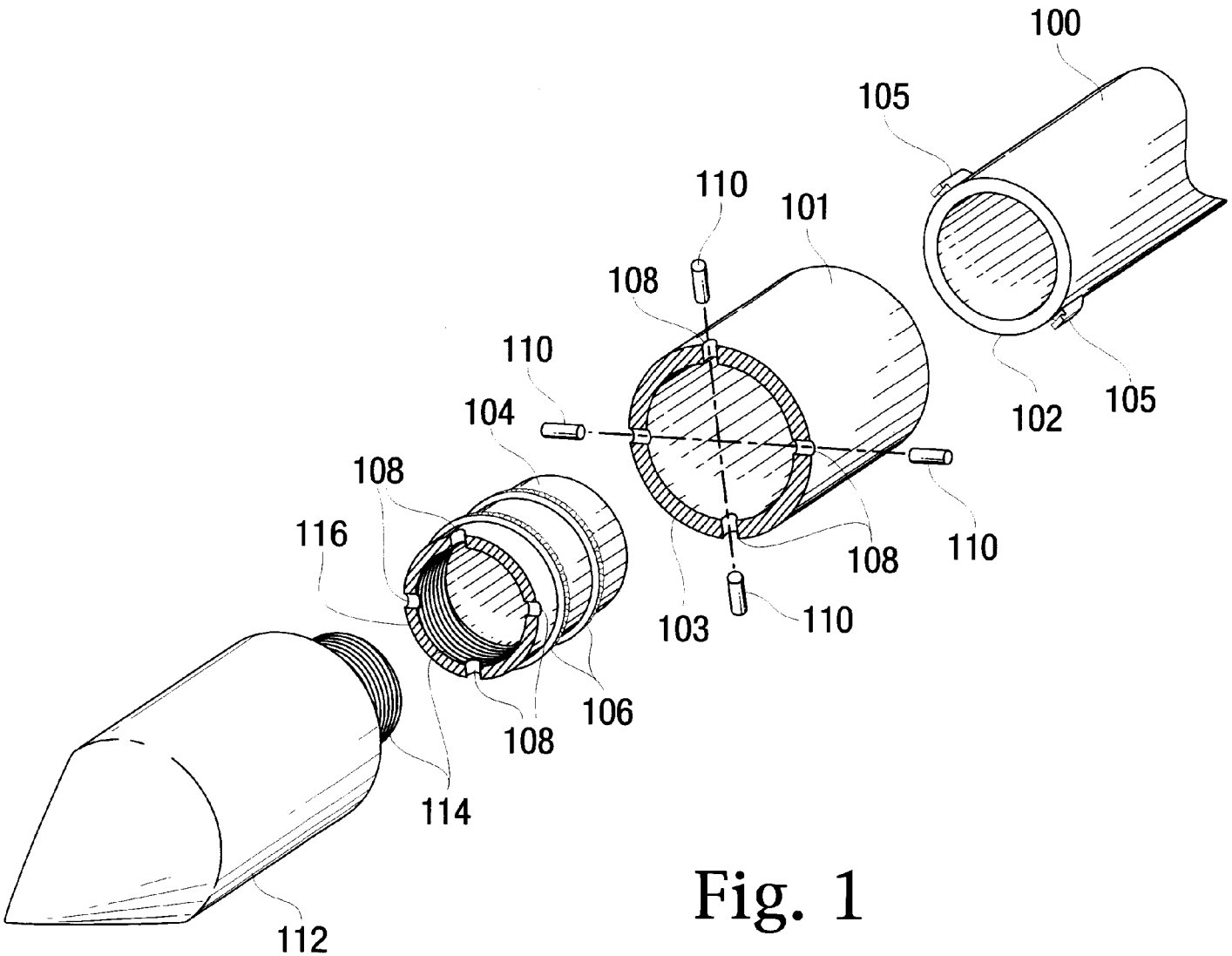
FIG. 1 is an exploded, angled view of an embodiment of the invention.

The invention, as embodied herein, comprises an improved precision rocket motor and warhead system using annular bearings to decouple the rocket motor from the warhead during use, thereby reducing the weight of the rocket motor and increasing its spin rate. The annular bearings are preferably made of a plastic material that is low-cost, easily manufactured and requires little or no maintenance over the length of the systems' shelf-life. The invention also comprises a method of increasing the precision of a rocket motor and warhead system using the annular bearings described herein to decouple the rocket motor from the warhead during use.

Referring to FIG. 1, the invention comprises a rocket motor tube 100 having an open end 102 that is attached to an outer housing segment 101. The outer housing segment 101 is attached on the outside of the end 102 so that the inner diameter of the outer housing segment 101 is slightly larger than the inner diameter of the rocket motor tube 100. Numerous methods of attachment can be used including threads or tabs. The embodiment of the invention shows two tabs 105 that click into place when the outer housing segment 101 is placed over the end 102 of the rocket motor tube 100. An annular sleeve 104 has at least two annular bearings 106 placed around it. The annular sleeve 104 is placed within the outer housing segment 101. The sleeve 104 will normally be placed with the end 116 of the sleeve 104 proximately aligned with the open end 103 of the outer housing segment 101. The outer diameter of the sleeve 104 plus the bearings 106 is such that the sleeve 104 will not slide into the rocket motor tube 100 due to the smaller diameter of the rocket motor tube 100 versus the outer housing segment, but, the bearings 106 still allow the sleeve 104 to spin within the outer housing segment when force is applied to the sleeve 104. In this configuration, the sleeve 104 may spin independently of the rocket motor tube 100. The invention also includes a locking mechanism 108, 110 that locks the sleeve 104 in place within the outer housing segment 101. This allows the warhead 112 to be attached to the sleeve using the warhead attachment mechanism 114.

The present invention was developed for use in the 2.75-inch rocket motor and warhead system, however, the invention may be employed within any rocket motor 100 and warhead 112 system. The sleeve 104 and the outer housing segment 101 will normally be constructed of a metal material with one preferred material being aluminum (the rocket motor tube 100 is normally constructed of the same material). The inner diameter of the outer housing segment 101, as noted above, will be slightly larger than the inner diameter of the rocket motor tube 100. The width of the outer housing segment 101 will be slightly larger than the width of the sleeve 104 as discussed below to allow the sleeve 104 to fit within the outer housing segment 101. The outer diameter of the sleeve 104 will depend upon the rocket motor 100 and warhead 112 system. The sleeve 104 should be designed to fit within the outer housing segment 101 so that it will not slide into the rocket motor tube 100. The outer diameter of the sleeve 104 plus the bearings 106 should also allow the bearings to spin within the outer housing segment 101. The width of the sleeve 104 can vary and may be determined by one skilled in the art as long as it fits within the outer housing segment 101. The width of the sleeve will normally increase with the size of the rocket motor 100 due to the normal forces at work on the sleeve 104 placed upon it by the rocket motor 100 and warhead 112.

The annular bearings 106 preferably are made from a plastic material that can be stretched around the sleeve 104 like a sock. The plastic material may be selected by one skilled in the art as long as the coefficient of friction of the material is low enough to allow the sleeve 104 to spin within the outer housing segment 101. Examples of preferred materials include polytetrafluoroethylene (teflon) and acetal. The coefficient of friction between teflon and aluminum is approximately is 0.04 and the coefficient of friction between aluminum and aluminum is approximately 1.04. Therefore, the material selected should comprise a coefficient of friction below 1.04 and more preferably below 0.20. By using a plastic material, the bearings 106 can be moldable parts, which significantly decrease manufacturing costs compared to parts such as custom ball bearings. Furthermore, plastics degrade very little over time, so the bearings 106 do not need to be sealed from the environment to improve shelf-life. For specific purposes, if a lower friction is desired between the bearings 106 and the outer housing segment 100, a dry film lubricant may be applied. Unlike lubricants used in conjunction with ball bearings (oil, etc.), dry film lubricants have proven to resilient against long term degredation.

The locking mechanism 108, 110 is needed to hold the sleeve 104 in place within the outer housing segment 101 while attaching the warhead 112 to the sleeve 104. Many possible locking mechanisms may be used and can be selected by one skilled in the art. One preferred example is set forth in FIG. 1. Four notches 108, approximately equidistant from one another, are made on the end 103 of the outer housing segment 101 and on the sleeve 104 on the side 116 aligned with the end 103. These notches 108 may be aligned and rods 110 can be placed through the notches 108 in order to hold the sleeve 104 immobile within the outer housing segment 101 while the warhead 112 is attached to the sleeve 104. The term "rods" within this application means any shape that fits through the notches 108 to hold the sleeve 104 immobile within the outer housing segment 101.

The warhead attachment mechanism 114 merely attaches the warhead 112 to the inner surface 118 of the sleeve 104. Many attachment mechanisms 114 are possible and, again, may be selected by one skilled in the art, including sealant and a screwing mechanism. One preferred warhead attachment mechanism, shown in FIG. 1, are matching threads on the inner surface 118 of the sleeve 104 and the outer surface of one side 120 of the warhead 112 that allow the user to screw the warhead 112 into the sleeve 104.

The invention also includes a method for improving the precision of a rocket motor and warhead system by using the annular bearing system described above. The user places the outer housing segment 101 on the rocket motor tube 100 and places annular sleeve 104, having the two annular bearings 106, within the outer housing segment 101. Then the user attaches the warhead 112 to the sleeve 104 and the rocket motor and warhead system is launched. The rocket motor tube 100 will spin from torque created by flutes within the rocket motor. The sleeve 104 and warhead 112 will spin independently due to the bearings 106 between the sleeve 104 and the outer housing segment 101. Thus, all of the torque created by the flutes will be used on only the weight of the rocket motor tube 100, to spin that portion of the system. The greater spin rate will result in improved precision of the system.

What is described are specific examples of many possible variations on the same invention and are not intended in a limiting sense. The claimed invention can be practiced using other variations not specifically described above.

What is claimed is:

1. An improved precision rocket motor and warhead system, comprising:

an outer housing segment attached to an outer edge of the rocket motor;

an annular sleeve placed within an end of the outer housing segment;

at least two annular bearings placed around an outer surface of the sleeve;

a warhead attachment mechanism to secure the warhead to an inner surface of the sleeve; and, a locking mechanism that locks the sleeve in place within the outer housing while attaching the warhead to the sleeve and unlocks to allow the sleeve to rotate independently of the rocket motor.

2. The rocket motor and warhead system of claim 1, wherein the two annular bearings comprise a plastic material.

3. The rocket motor and warhead system of claim 2, wherein the plastic material is selected from teflon or acetal.

4. The rocket motor and warhead system of claim 3, wherein the warhead attachment mechanism comprise matching threaded surfaces on the inner surface of the sleeve and an outer end of the warhead.

5. The rocket motor and warhead system of claim 4, wherein the locking mechanism comprises:

at least one notch in an outer end of the outer housing segment;

at least one notch in an end of the sleeve; and, at least one rod that fits within the notches wherein the sleeve cannot rotate within the outer housing segment until the removal of the at least one rod.

6. The rocket motor and warhead system of claim 5, wherein the bearings comprise an outer diameter smaller than an inner diameter of the outer housing segment wherein the bearings rotatably contact an inner surface of the outer housing segment.

7. The rocket motor and warhead system of claim 6, further comprising a dry film lubricant on the bearings.

8. The rocket motor warhead system of claim 7, wherein the locking mechanism comprises:

four notches approximately equally spaced around the end of the outer housing segment;

four notches approximately equally spaced around the end of the sleeve; and, four rods that fits within the notches wherein the sleeve cannot rotate within the outer housing segment until the removal of the rods.

9. A method for improving the precision of a rocket motor and warhead system, comprising:

providing an annular sleeve having at least two annular bearings around an outer surface of the sleeve;

attaching an outer housing segment to an end of the rocket motor;

placing the sleeve within an end of the outer housing segment;

attaching the warhead to an inner surface of the sleeve; and, lauching the rocket motor and warhead system wherein the rocket motor spins independently from the sleeve and warhead.

10. The method of claim 9, wherein the two bearings comprise a plastic.

11. The method of claim 10, wherein the plastic is selected from teflon or acetal.

12. The method of claim 11, wherein the step of attaching comprises screwing matching threaded surfaces on an inner surface of the sleeve and an outer end of the warhead.

13. The method of claim 12, wherein the step of attaching further comprises locking the sleeve within the outer housing segment before screwing.

14. The method of claim 13, wherein the locking comprises placing at least one rod through at least one notch in an end of the outer housing segment, aligned with at least one notch in an end of the sleeve.

15. The method of claim 14, further comprising the step of removing the at least one rod before the step of launching.

16. The method of claim 15, further comprising a dry film lubricant placed upon the bearings.

* * * * *